United States Patent [19]

Kline et al.

[11] Patent Number: 4,821,955

[45] Date of Patent: Apr. 18, 1989

[54] THERMALLY-POWERED ACTIVE MASTER AND PASSIVE SATELLITE AIR DIFFUSER SYSTEM

[75] Inventors: James R. Kline, Moraga; Robert S. Hunka, Berkeley, both of Calif.

[73] Assignee: Acutherm, Ltd., Emeryville, Calif.

[21] Appl. No.: 149,704

[22] Filed: Jan. 29, 1988

[51] Int. Cl.[4] ..... F24F 13/14

[52] U.S. Cl. ..... 236/49.3; 165/22

[58] Field of Search ..... 236/49 B, 49 C; 165/22

[56] References Cited

U.S. PATENT DOCUMENTS

| | | | |
|---|---|---|---|
| Re. 30,953 | 6/1982 | Vance et al. | 236/49 B |
| 2,932,454 | 4/1960 | Dillman | 236/12 |
| 3,117,723 | 1/1964 | Church | 236/49 |
| 3,442,078 | 5/1969 | Nolan | 60/23 |
| 3,732,799 | 5/1973 | Spoormaker | 98/38 |
| 3,743,180 | 7/1973 | Perkins et al. | 236/49 B X |
| 3,824,800 | 7/1974 | Church | 62/186 |
| 4,123,001 | 10/1978 | Kolt | 236/49 |
| 4,238,071 | 12/1980 | Post | 236/49 |
| 4,284,237 | 8/1981 | Harris et al. | 236/49 C |
| 4,406,397 | 9/1983 | Kamata et al. | 165/22 X |
| 4,491,270 | 1/1985 | Brand | 236/49 B |
| 4,509,678 | 4/1985 | Noll | 236/49 |
| 4,523,713 | 6/1985 | Kline et al. | 236/49 B X |
| 4,537,348 | 8/1985 | Noll et al. | 236/49 |
| 4,570,850 | 2/1986 | McDermott | 236/49 |
| 4,697,736 | 10/1987 | Kolt | 236/49 |

*Primary Examiner*—William E. Tapolcai

*Attorney, Agent, or Firm*—Flehr, Hohbach, Albritton & Herbert

[57] ABSTRACT

A thermally-powered active master and passive satellite or slave diffuser system is disclosed. The system includes a master diffuser (24) with a displaceable damper assembly (41) mounted in the diffuser housing (31) and a thermal sensor-actuator assembly (46) positioned proximate the damper assembly (41) and proximate the master outlet (34, 58). An induction channel (47) communicates secondary air from proximate the master discharge outlet (34, 58) to the thermal sensor-actuator assembly (46) for accurate control of modulation by the damper assembly (41) of air flow to both the master (24) and passive slave (26) diffusers. The thermal sensor-actuator assembly (46) is capable of both cooling and heating and employs opposed sensor-actuator units (81, 102, 111) with override mountings (126, 128, 141) to effect changeover between heating and cooling.

17 Claims, 4 Drawing Sheets

FIG._4
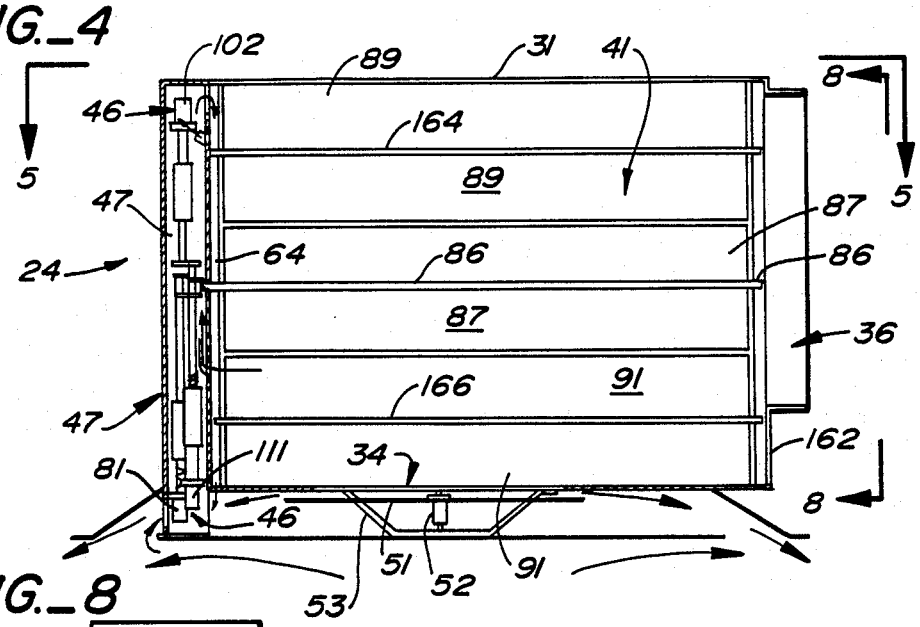
FIG._8
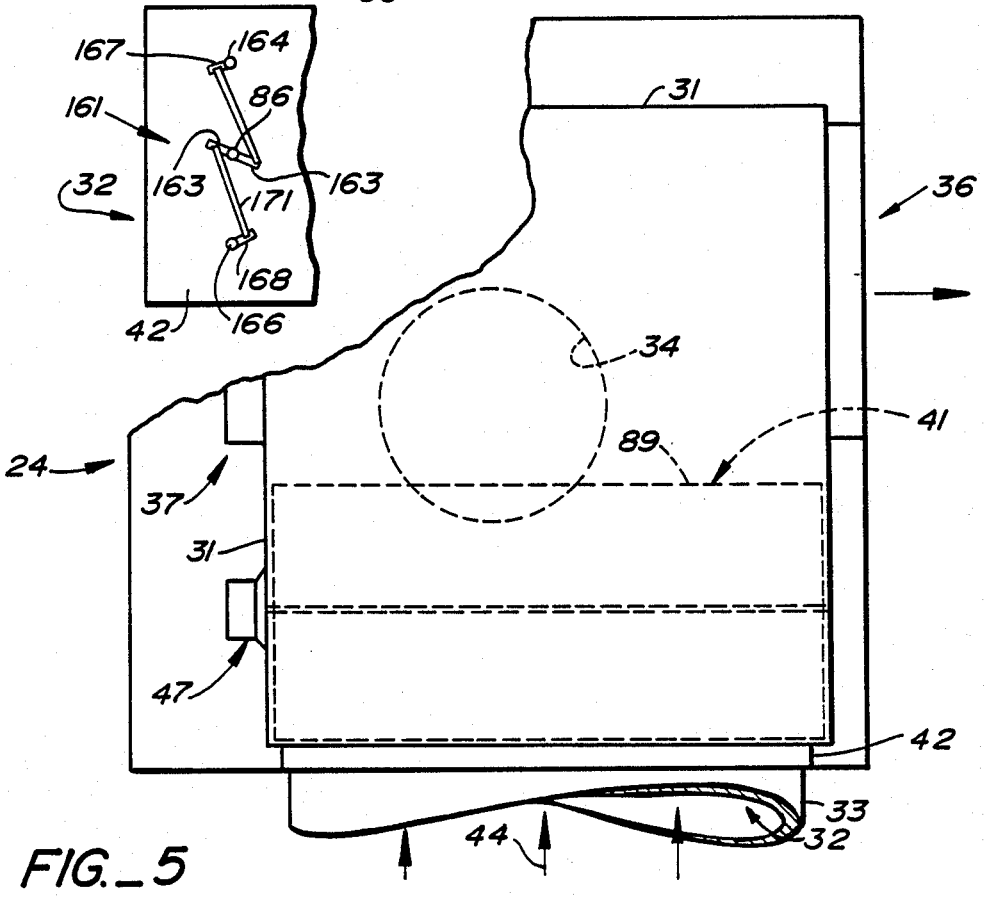
FIG._5

THERMALLY-POWERED ACTIVE MASTER AND PASSIVE SATELLITE AIR DIFFUSER SYSTEM

TECHNICAL FIELD

The present invention relates, in general, to air diffuser apparatus and methods, and more particularly, relates to thermally-powered air diffuser systems in which there are a plurality of air diffusers delivering conditioned air to a plurality of rooms or spaces.

BACKGROUND ART

One of the most common techniques for the controlled delivery of conditioned air (heated, cooled or both) to a plurality of rooms in a structure is to use a variable air volume (VAV), constant temperature system. The conditioned air from a central source is discharged into the various spaces or rooms through a plurality of diffusers located in the rooms. One common approach to the control of such air conditioning systems is to use a thermostat located in each room, which thermostat regulates a damper or control plate in the diffuser to modulate the volume of air discharged into the room, depending upon the temperature demand of the room as sensed by the room thermostat. U.S. Pat. Nos. 3,117,723, 3,824,800 and 4,238,071, for example, disclose room thermostat controlled air diffusers in which the thermostat controls the operation of a pneumatic actuator for the diffuser damper.

Thermally-powered diffuser damper assembly actuators also have been employed in connection with air conditioning systems. U.S. Pat. Nos. 3,732,799, 3,743,180, 4,123,001, 4,509,678, 4,537,347, 4,570,850 and 4,697,736 are all examples of the use of thermal sensor-actuators which have been used to drive damper assemblies in connection with air diffusers and ventilating systems. Such diffusers typically employ a sensor-actuator element (e.g., U.S. Pat. Nos. 2,932,454 and 3,442,078) of the type which has been widely used in the automobile industry in connection with the control of radiator relief valves.

Thermally-powered air diffusers have the advantage of essentially incorporating the thermal sensor function of a thermostat directly into the diffuser assembly itself. This avoids the necessity for wiring or other couplings between a room thermostat and the diffuser. Moreover, thermal sensor-actuators provide the power for operation of the diffuser damper assembly, which eliminates the need for supplying outside power to each diffuser. The result has been that such thermally-powered sensor-actuator diffusers inherently are less costly than conventional thermostat controlled systems.

Through the use of various combinations of thermal sensor-actuator systems which are capable of cooling drive assemblies, thermally-powered sensor-actuators can be used to control both heating and cooling of a space. U.S. Pat. Nos. Re. 30,953, 4,491,270 and 4,523,713, for example, disclose thermally-powered sensor-actuator systems which are capable of cooling only, cooling with warm-up heating, and cooling and heating. The sensor-actuators are positioned so as to sense both the duct or supply air temperature and the room or secondary air temperature.

Secondary air temperature is particularly valuable in accurately controlling air diffuser operation. One of the functions in an air diffuser is to distribute air evenly along the ceiling of a room without undesirable dumping so that the conditioned air will entrain the room air so that a pattern of air circulation in the room will be established which is highly effective in mixing the conditioned air with the room air. The result that is desired is for the air circulating in the room to follow donut or toroidal paths and return backup to the diffuser. The secondary air returning to the diffuser will have a temperature which is very close to the average temperature of the room. Controlling diffuser operation based upon this average room temperature, rather than a temperature sensed along a wall, which is where most thermostats are located, results in better control of the conditioning of the room air.

One of the important considerations when using thermally-powered sensor-actuators to control diffuser operations is that the assembly or linkage which drives the diffuser damper blade assembly must not contain too much friction or undesirable hysterisis. Thus, close coupling or positioning of the sensor-actuators to the damper assembly which is to be driven is highly desirable.

While thermally-powered sensor-actuator driven diffuser systems are less expensive than conventional thermostat controlled diffusers, there are installations in which it would be highly desirable to be able to further reduce the cost of an air diffuser system. In most buildings, for example, the heating and cooling load in many rooms is essentially the same. Thus, it is quite possible and highly advantageous from the view point of costs to employ a master-slave or active terminal and passive satellite air diffuser system. In such systems, one of the diffusers is active or controlled, while the others are passive or merely follow or are slaved to the master. This approach has been employed extensively with conventional thermostat-controlled diffuser systems with attendant cost savings. Typical of the commercially available prior art active master terminal and passive satellite or slave terminals is the MODULINE air terminal system manufactured by Carrier Corporation and described in the Carrier product brochure entitle "Carrier Moduline Air Terminals." A similar system is manufactured by York and sold under the model designation Model ISCS. Master-satellite diffuser systems have not heretofore been employed in thermally powered systems. Further cost savings could be achieved, however, if a thermally-powered master-slave air diffuser system could be developed.

Accordingly, it is an object of the present invention to provide a thermally-powered active master and passive satellite air diffuser system having a high degree of responsiveness and accuracy in controlling the air discharged therefrom.

Another object of the present invention is to provide a thermally-powered master diffuser for use in a master-slave air diffuser system which can be packaged as a single unit for ease of installation and ease of coupling to slave units control operation of the slave units.

Still another object of the present invention is to provide a method for sensing and thermally powering a master-slave diffuser system which has enhanced precision of performance and is adaptable to a wide range of installations.

Still a further object of the present invention is to provide a thermally-powered, master-slave air diffuser system in which the driving of the flow control damper assembly is enhanced.

It is an object of the present invention to provide a thermally-powered, master-slave air diffuser apparatus and method which is easy to install, reliable in its operation, durable and requires little maintenance, and can be adjusted and adapted to a wide range of installations.

The thermally-powered, master-slave air diffuser system of the present invention has other objects and features of advantage which will become apparent from the accompanying drawings and are set forth in more detail in the following description of the Best Mode Of Carrying Out The Invention.

DISCLOSURE OF INVENTION

The thermally-powered, variable air volume, active master and passive satellite diffuser system of the present invention comprises, briefly, a master diffuser having a housing with an air supply inlet, an air discharge master outlet, and an air discharge auxiliary outlet. The master diffuser further has a displaceable damper assembly mounted in the housing to control the flow of air from the supply inlet to both of the master outlet and the auxiliary outlet. At least one passive slave diffuser is positioned in space relation to the master and is coupled thereto by an air distribution duct. Thermal sensor-actuator means are positioned in the master diffuser proximate the master outlet and proximate the damper assembly. The thermal sensor-actuator is responsive to temperature changes to displace or drive the damper assembly for modulation of the air flow between the inlet and the master and auxiliary outlets. The master diffuser further includes induction means communicating with the sensor-actuator and inducing the flow of secondary air to the sensor-actuator means for temperature-based control of damper assembly displacement.

The thermal sensor-actuator assembly of the present invention preferably includes a plurality of sensor-actuator units which are mounted relative to a damper displacement assembly for driving of the same and are mounted relative to the master diffuser discharge so as to see, or receive, induced secondary air proximate the discharge. The assembly of sensor-actuator units further includes a combination of resilient biasing means which minimize hysteresis losses and enable the assembly to be sufficiently compact for positioning close to diffuser discharge outlet and to the damper assembly.

BRIEF DESCRIPTION OF THE DRAWING

FIG. 4 is an end elevation view, partially in cross section, and taken substantially along the plane of line 4—4 of FIG. 3.

FIG. 5 is a top plan view taken substantially along the plane of line 5—5 of FIG. 4.

FIG. 8 is a reduced, fragmentary, side elevation view taken substantially along the plane of line 8—8 of FIG. 4.

BEST MODE OF CARRYING OUT THE INVENTION

Figures 1, 7:
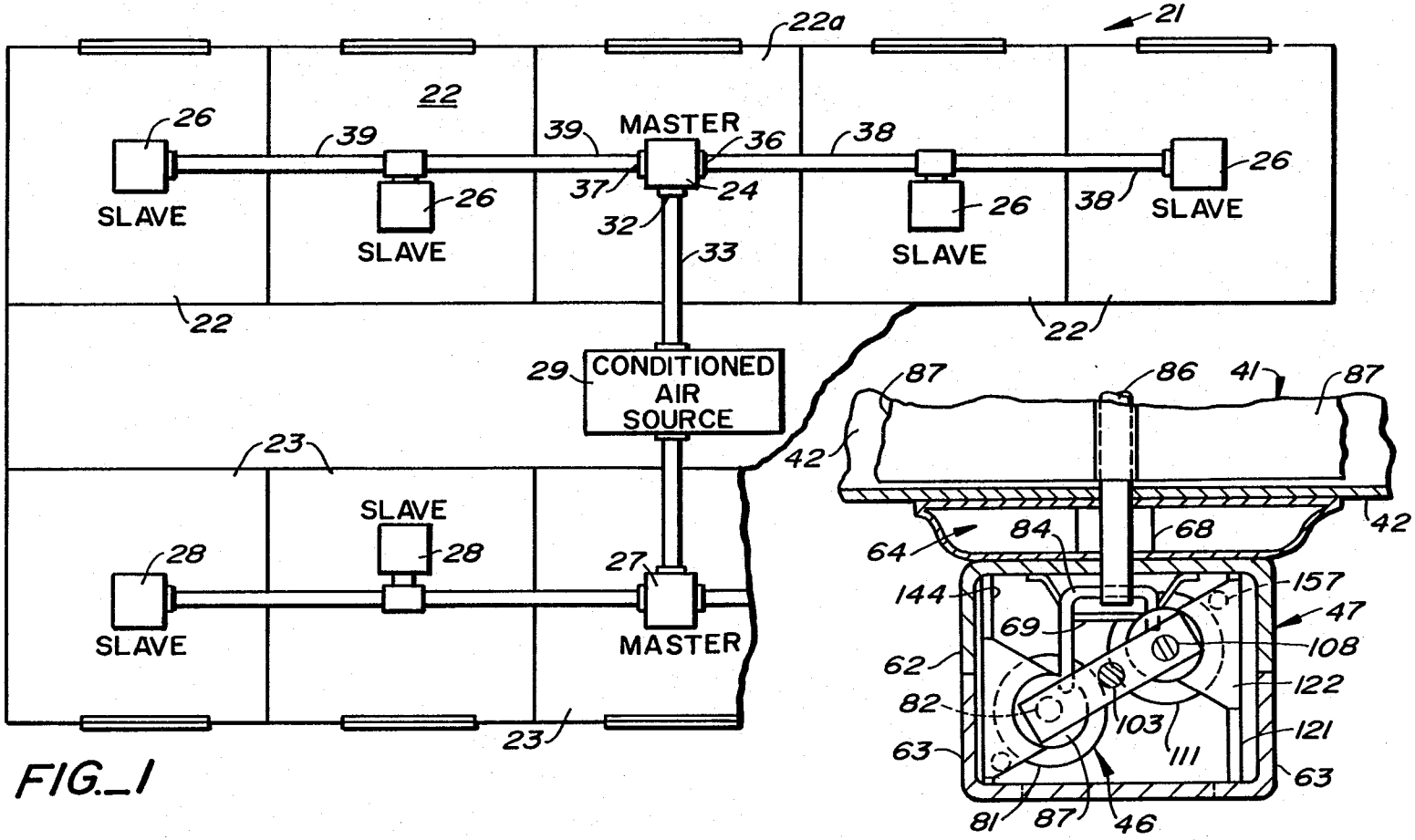
FIG. 1 is a schematic top plan view of a structure having a plurality of rooms in which the thermally-powered active master and passive satellite air diffuser system of the present invention is installed.
FIG. 7 is an enlarged, fragmentary, cross section view taken substantially along the plane of line 7—7 of FIG. 6.

The thermally-powered active master and passive satellite or slave air conditioning system of the present invention is particularly well suited for air conditioning a building or structure such as is shown and designated generally 21 in FIG. 1. In building 21 there are a plurality of rooms or spaces which have similar heating and cooling requirements. The rooms 22, for example, all face the same direction and have approximately the same area and exposure, with the possible exception of the corner rooms. Rooms 23 on the other side of structure 21 are similarly situated and also will have quite similar heating and cooling requirements. In such structures, it is quite possible to employ an air conditioning system in which a master diffuser, such as diffuser 24, controls a plurality of passive slave or satellite diffusers, such as diffusers 26, while a second master diffuser 27 controls slaves or satellites 28 in rooms 23 on the opposite side of structure 21. The system further includes a conditioned air source 29 preferably with a supply air temperature thermostat (not shown).

The master diffuser 24 regulates operation of passive slaves 26 in accordance with the load experienced in room **22*a*. While not as precise as having individual thermally-powered diffusers in each of rooms 22, the active master and passive satellite system is often entirely adequate and results in considerable cost savings as compared to the use of independent active diffusers in each room. As thus far described, such master-slave diffuser systems are well known in the industry and typically employ a thermostat on the wall of the master diffuser room 22*a*** or at the master diffuser itself. Such thermostatically controlled systems can be used to control mechanical, electrical or pneumatic actuators to effect displacement of a damper assembly in the master diffuser or duct work proximate the diffuser.

In order to attempt to further reduce the cost of air diffuser systems, and in order to, simplify the installation, the active master and passive satellite diffuser system of the present invention is thermally powered. Moreover, this thermal powering is achieved while maintaining the thermal sensor-actuator units in a closely associated relationship to the diffuser damper assembly so as to avoid hysteresis problems. Still further, the thermally-powered sensor-actuator assembly is positioned close to the diffuser discharge outlet so as to enable secondary air, representing average room temperature, to be induced through and past the sensor-actuators for accurate damper assembly control.

Figure 2:
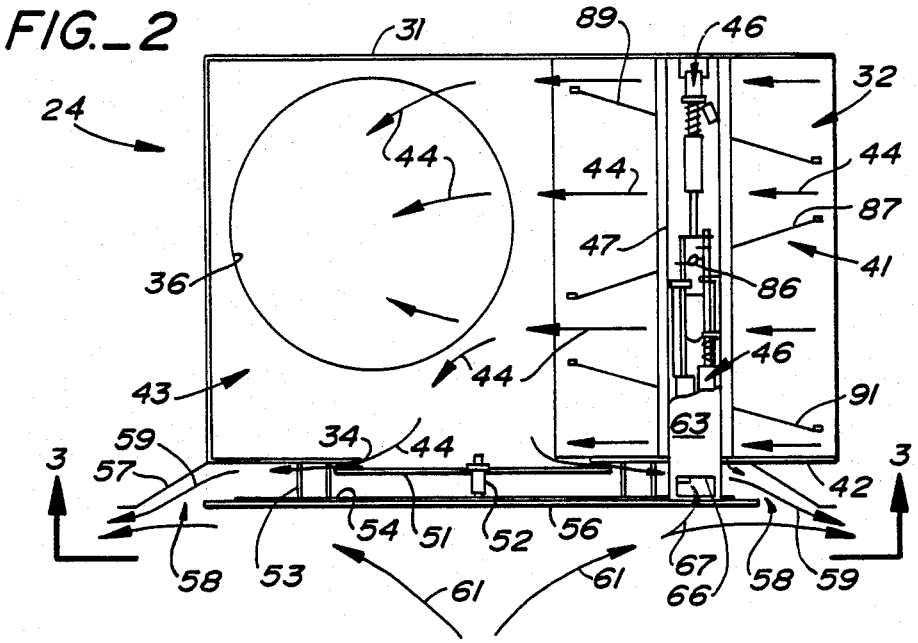
FIG. 2 is a side elevation view, in cross section of a master diffuser assembly constructed in accordance with the present invention.
Figure 3:
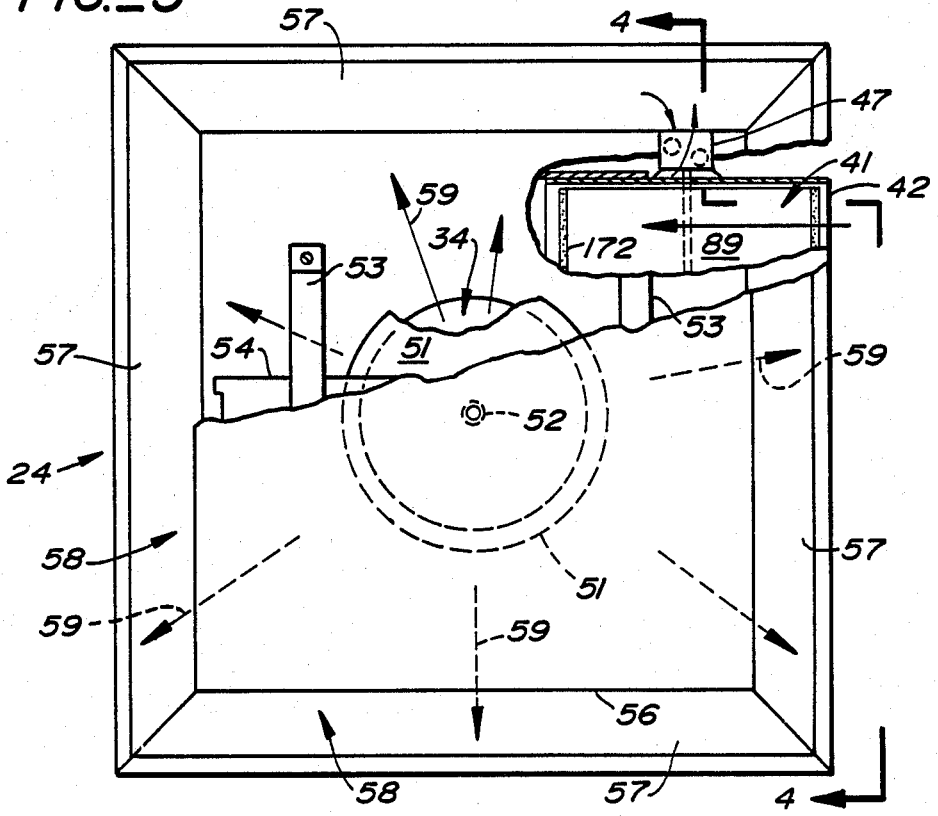
FIG. 3 is a bottom plan view taken substantially along the plane of line 3—3 of FIG. 2, with portions of the assembly broken away.

Referring now to FIG. 2, further details of the active master and passive satellite diffuser system of the present invention can be described. Master diffuser assembly 24 is formed with a housing 31 having an air supply inlet 32 for receipt of supply air from conditioned air source 29 through conduit 33. Housing 31 is also formed with an adjustable, but passive, air discharge master outlet 34 and at least one air discharge auxiliary outlet 36. As shown in the drawing, master diffuser 24 includes two auxiliary outlets 36 and 37 which are coupled by conduits 38 and 39 (FIG. 1) to passive slave diffusers 26. Master diffuser 27 preferably is identical in structure to diffuser 24.

In order to enable simultaneous control of the flow of conditioned air to both the master and slave diffusers, master diffuser 24 further includes a damper assembly, generally designated 41, mounted in housing 31 for movement between a closed position (FIGS. 4 and 6) and an open position (FIG. 2). Damper assembly 41 is positioned in a rectangular inlet collar portion 42 of housing 31 which discharges into a distribution chamber 43 inside the housing which is in flow communication with both auxiliary outlets 36 and 37 and master discharge outlet 34. Accordingly, when the damper assembly is in the closed position air from supply source 29 cannot flow to either of the master or auxiliary outlets. When damper assembly 41 is open, supply air flows to both outlets, as indicated by air flow arrows 44 in FIG. 2.

Thermal powering of the displacement of damper assembly 41 is achieved through thermal sensor-actuator means or assembly 46. It is an important feature of the active master and passive satellite diffuser system of the present invention that the thermal sensor-actuator assembly be positioned for sensing of room air temperature close to the bottom of the diffuser so as to see or sense an average room air temperature of recirculating secondary air.

In order to achieve the end of sampling secondary air, master diffuser 24 includes air induction means, generally designated 47, which induces flow of secondary air from the room or space 22*a* up beyond thermal sensor-actuator assembly 46.

Circulation in the space 22*a* will assume a generally toroidal circulation pattern. Thus, diffuser 24 is provided with a disk or discharge control plate 51 which is adjustably mounted by adjustment means 52 to housing or frame members 53 and 54. Disk or plate 51 causes flow out of discharge outlet 34 to be radially directed toward the periphery of the diffuser housing and the room in a 360 degree pattern around the opening 34. The periphery of appearance panel 56 and the downwardly sloping skirt 57 direct discharge out the space 58 therebetween so that the flow of air will be generally parallel to or closely hug the ceiling of the room to take advantage of the Coanda effect. Arrows 59 generally illustrate the flow of the discharge of supply or conditioned air from the diffuser.

The conditioned air will tend to hug the ceiling as it radiates away from the diffuser and then drop gradually down along the walls. Once the air reaches the floor, the circulation pattern in the room proceeds back toward the center of the room and then back up toward the diffuser. The secondary air induced by the supply back toward the diffuser, as indicated by arrows 61 in FIG. 2, will be at a temperature which very closely approximates an average temperature for the room being air conditioned. Location of air induction means 47 at the master diffuser in a position to see or sample the secondary air as it recirculates back to the diffuser affords a much more accurate control than would be the case if a wall-mounted thermostat or remotely mounted thermal sensor-actuator assembly were employed. This is particularly important when a active master and passive satellite diffuser system is used since such systems inherently control a plurality of rooms based upon only one temperature sensing location. If the location does not yield truly representative input as to the room temperature, the air conditioning of all rooms will suffer, not only because of their individual differences, but because of the inaccuracy of temperature sensing in the master diffuser room.

Induction Assembly

While various forms of induction means are suitable for use with the present invention, as long as the sample proximate the master diffuser, is preferable that induction means 47 take the form of an induction channel in which thermal sensor-actuator means 46 is mounted. As best may be seen in FIG. 7, induction channel 47 is comprised of two C-shaped members 62 and 63 which cause the longitudinally extending channel to have a rectangular cross section. The channel halves 62 and 63 are preferably removably mounted to each other so as to permit assembly of the sensor-actuator means in the channel and to allow access to the same for maintenance or replacement.

Additionally, a second vertically extending channel 64 is preferably provided which is in air flow communication with channel 62-63 in which the sensor-actuator assembly is mounted. The bottom of the induction channel 47 includes an opening 66 into which returning secondary air flows, as indicated by arrow 67 in FIGS. 2 and 6. A passageway or conduit 68 extends from the inside of supply inlet channel 42 upstream of damper 41 through vertical induction return channel 64 and into the vertical channel formed by members 62 and 63. A nozzle 69 redirects the supply air for flow in an upward direction, as indicated by arrow 71. Thus, supply air from source 29 is able to flow into induction channel 47 through passageway 68 and up the induction channel in the direction of arrow 71 to induce secondary air into channel 47. It will be noted that the location of passageway means 68 is above two of the thermal sensor-actuator units so that supply air does not influence the lower two sensor-actuator units.

Additionally, it is preferable that a second passageway 72 and director member or nozzle 73 be positioned at an upper end of the induction channel for the flow of supply air across an upper sensor-actuator unit, as indicated by arrow 74. Both passageways 68 and 72 will tend to induce flow in an upward direction in the induction channel and thereby cause a portion of the secondary air 61 to enter opening 66, as shown by arrow 67.

In order to insure that the air in induction channel 47 is discharged or dumped into a low pressure area, it is preferable that return channel 64 and induction channel 47 have an opening at 76 in the upper ends thereof for communication of air in the induction channel 47 to the return channel 64, as indicated by arrow 77. The lower end of channel 64 is preferably open for discharge of air in the channel to the room along skirt 57, as shown by arrow 78 in FIG. 6. As will be understood, it is also possible to simply discharge air out of induction channel 47 into the plenum which is typically above the diffuser and the ceiling of the room. Such a discharge, however, is not as desirable as discharge back into the room, particularly proximate the air flow discharging from the master outlet 34.

As will be apparent from the above description, therefore, the lower two thermal sensor-actuator units will be exposed to secondary air induced into the induction channel at a location in the room which will yield a good average room temperature. The upper sensor-actuator unit will see or be exposed to supply air 44 from passageway 72, as well as a mixture of supply air and secondary air. These two air temperatures can be used to control or modulate the flow of air through the diffuser in a manner which will be described more fully hereinafter.

Sensor-Actuated Assembly

The details of construction of sensor-actuator assembly 46 and the manner in which it drives damper assembly 41 can now be described. It is a feature of the active master and passive satellite diffuser system of the present invention that it can be used for any one or all of the following possible functions:

1. cooling only;
2. cooling with warm-up;
3. heating and cooling; and
4. heating only.

If diffuser 24 is to be used to distribute cooling air only, sensor-actuator assembly 46 can be constructed with a single sensor-actuator unit, namely first unit 81. Sensor-actuator unit 81 includes a wax material which is contained in a reservoir and displaces a piston 82 outwardly of the reservoir in response to increasing sensed temperature. In order to displace damper assembly 41, a displacement or drive assembly, generally designated 83, is provided. The displacement assembly includes drive arm means 84 which is mounted to rotate or drive axle 86 on which damper blade 87 is carried. The axle 86 is rotatably mounted to housing 31 to permit damper blade movement between the closed position of FIG. 6 and an open position, such as is shown in FIG. 2. Mounted to piston 82 is a member 87, for example an arm or washer, which extends laterally of piston 82 so as to engage damper displacement arm 84. If a single cooling-only unit is to be employed, the member 87 can be eliminated and the end 88 of piston 82 can directly engage drive arm 84.

In a cooling-only mode of operation, supply air 44 comes from source 29 at a cool temperature established by the source and a supply thermostat. The temperature is maintained at a constant level and the flow of air into the room is varied in order to control conditioning of the room. If room or space 22*a* is hot, the air flow 67 induced into induction channel 47 will be warm and pass over the first thermal sensor-actuator 81. This will cause piston 82 to be extended, and element 87 will engage arm 84 to rotate axle 86 in a clockwise direction. This opens damper blade 87, which in turn drives damper blades 89 and 91 to an open position through a linkage which will be more fully set forth hereinafter. The volume of air in room 22*a*, and in all the rooms 22 served by passive slave or satellite diffusers 26, will receive cool air from air source 29 through master diffuser 24 and slaves 26.

As the cool air lowers the average temperature of room 22*a*, first sensor-actuator 81 will begin to sense such temperature and the wax therein will contract. Mounted on each of the sensor-actuators is a return spring cartridge 92. The lower end 93 of the spring cartridge is threadably mounted on threaded end 94 of the sensor-actuator unit 81. Positioned concentrically about piston 82 is a compression spring 96 which bears at one end upon the end 97 of cartridge 92 and at the opposite end upon an E-ring or other fastener 99 secured to piston 82. Compression spring 96, therefore, tends to drive piston 82 toward the reservoir for sensor-actuator unit 81. This biasing of the piston toward the reservoir allows the piston to track or follow the expansion of wax in the sensor-actuator reservoir. Such biasing is broadly known in the art, for example, as is shown in U.S. Pat. No. 4,535,932.

It is further preferable that damper assembly 41, and particularly blade 87, be biased to a closed position. This can advantageously be accomplished by mounting a weight 101 on damper blade 87 at a distance from axle 86. Spring biasing also may be used. When cool air is sensed by actuator 81, piston 82 will be retracted and element 87 will move away from drive arm 84. Weight 101 will rotate blade 87 in a counterclockwise direction, and through the damper displacement linkage all blades will move toward a closed position. When the secondary air induced through induction channel 47 reaches the desired air conditioning set point, damper assembly 41 will modulate about the set point to admit sufficient air to satisfy the thermal load of the room. If the room heats back up, first sensor-actuator 81 will again drive arm 84 in a clockwise direction to open the damper assembly further and admit more cool air to the master and slave diffusers.

The master diffuser of the present invention can be used not only to cool, but also to provide a warm-up feature for applications in which there is, for example, a need to warm the building up before entering the cooling mode. Such a warm-up function can be provided by mounting a second sensor-actuator unit 102 in channel 46 in opposed relation to first unit 81. Second sensor-actuator unit 102 is constructed as described in connection with unit 81 and includes a piston 103 with a spring biasing cartridge 104 which will cause the piston to track expansion and contraction of wax in the sensor-actuator unit.

In order to provide a warm-up feature, sensor actuator unit 102 includes a laterally extending arm 106 which can be used to drive arm 84. In the assembly shown in the drawing the end of piston 107 is slidably received in a bore in member 106. A shoulder 108 limits movement of member 106 away from piston 107, but for the purpose of illustrating a warm-up feature, piston 107 and drive projection or washer 109 can be assumed to be secured to member 106 as a rigid unit. Thus, drive member 109 extends laterally of piston 107 a sufficient distance to engage on opposite side of damper drive arm 84.

If cooling with a warm up is all that is desired, therefore, third piston 107 is merely an extension of member 106 on which a drive element 109 can be mounted. There is no requirement for the third sensor-actuator 111 when cooling with a warm up is all that is desired.

In operation in a cooling with warm-up mode, the induction channel will cause cool air to pass by first sensor-actuator 81 in channel 47. This will retract piston 82 and cause the damper to assume a closed position. If hot air is supplied by source 29, however, passageway 72 will communicate hot air from the upstream side of damper assembly 41 through the nozzle or director conduit 73 across second sensor-actuator 102. This hot air will cause the piston 103 to be driven downwardly. As piston 103 moves downwardly, the element 109 engages drive arm 84 and again rotates the drive arm in a clockwise direction to open damper assembly 41, notwithstanding retraction of piston 82 as a result of cold room air passing over first sensor-actuator 81.

When the warm-up mode is complete, for example based upon a timing controller, cool air will then enter supply conduit 33 and pass out through nozzle 73 over second sensor-actuator 102. This will cause retraction of piston 103 and closing of damper assembly 41, as biased by weight 101. If, however, the space 22*a* has now begun to overheat, the first sensor-actuator 81 will sense that heating and drive the damper assembly open so that the cool air can be discharged into space 22a and the spaces 22 in which the slave units 26 are positioned. Thus, the addition of a second opposed sensor-actuator unit 102 permits operation in a cooling with warm-up feature.

The addition of a third sensor-actuator 111 permits master diffuser 24 to be used as both a cooling and a heating diffuser. Third sensor-actuator 111 senses the temperature of room air, rather than supply air. Thus, it is essentially seeing the same temperature as does first sensor-actuator 81. Instead of opening damper assembly 41 upon the presence of warm room air, however, the third sensor-actuator opens damper assembly 41 only upon sensing cold room air because of the location of drive element 109 with respect to U-shaped drive arm 84.

The changeover to heating using the sensor-actuator assembly 46 is accomplished as follows. If source 29 is providing cool air down duct 33, second sensor-actuator 102 will be seeing the cooling air and piston 103 will be retracted so that element 109 is not engaged with drive arm 84. If the room is already cool, the cool room air induced into channel 47 will cause sensor-actuator 81 to retract piston 82. Additionally, cool room air will try to retract piston 107 in third sensor-actuator 111. The third sensor-actuator 111, however, is mounted in a frame member 121 which has three laterally extending tabs 122, 123 and 124. Mounted between tab 123 and spring cartridge 127 is an override compression spring 126.

Since piston 107 is stopped by a shoulder 108 to the member 106 carried by second sensor-actuator piston 103, contraction of the wax in third sensor-actuator 111 cannot retract piston 107. Instead, second sensor-actuator 102 holds the piston 107 and the entire third sensor-actuator assembly moves in framework 121 upwardly while compressing override spring 126. Thus, damper assembly 41 remains in the closed position, as biased by weight 101, even though both the first and third sensor-actuators want to retract their respective pistons. The retraction of piston 107 is converted into upward movement of the third sensor-actuator by reason of coupling of the third piston 107 to second sensor-actuator piston 103.

Figure 6:
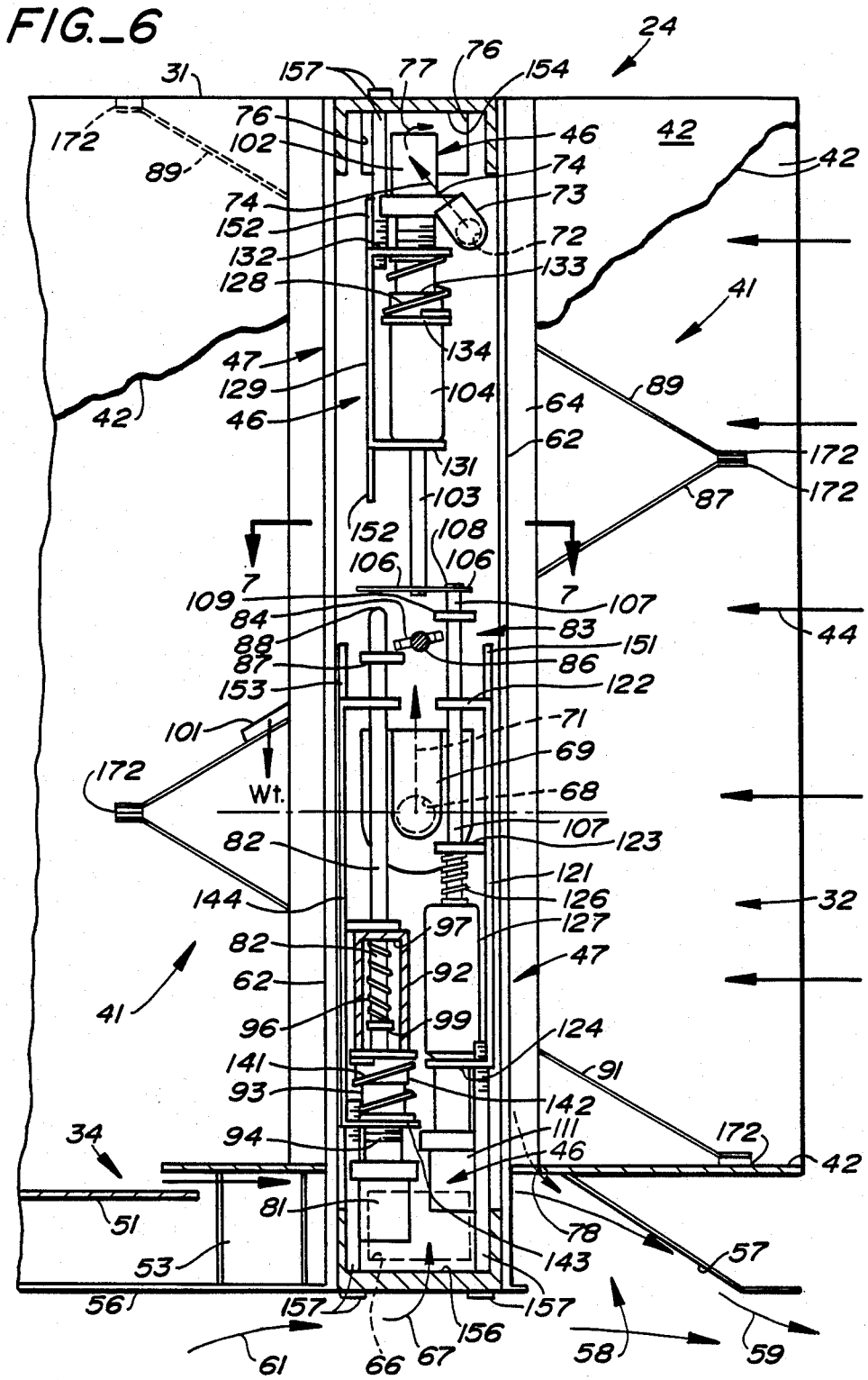
FIG. 6 is an enlarged, fragmentary, side elevation view of the thermal sensor-actuator assembly portion of the master diffuser of FIG. 2.

As will be seen in FIG. 6, the second sensor-actuator 102 also includes a spring 128 concentrically mounted about cartridge 104. Second sensor-actuator 102 is similarly mounted to a longitudinally extending frame 129 which includes laterally extending tabs 131 and 132. A cup-like member 133 is concentrically mounted on cartridge 104 to provide a shoulder 134 against which 128 may bear. The opposite end of spring 128 bears upon tab 132 so as to provide an override capability at the second sensor-actuator.

It will be apparent that compression spring 128 must provide a biasing force which is greater than compression spring 126, or else retraction of third sensor-actuator 111 will cause displacement of the second sensor-actuator 102, which is not desired. If, for example, the sensor-actuator assembly is subjected to temperatures beyond the normal operating range, it is possible for a condition to exist in which spring 126 is essentially fully compressed, and second sensor-actuator 102 continues to contract beyond full compression of spring 126. At that point, spring 133 would begin to be compressed and second sensor-actuator 102 would be downwardly displaced in frame 129 with spring 128 being compressed. This is an override feature which prevents pulling of the pistons away from the wax reservoirs or bending of frames in which the thermal sensor-actuators are mounted.

In the situation in which cool air is supplied and the room is cool, therefore, assembly 46 will maintain the dampers in the closed position. As the room begins to heat up, both the first and third sensor-actuators will cause extension of the respective pistons. Extension of piston 107 will essentially relax spring 126 and not effect opening of the damper initially. Extension of piston 82, however, will cause displacement of damper driver arm 84 in clockwise direction to open the damper and permit cool air into the room. First sensor-actuator 81 will modulate the damper opening in accordance with the room temperature sensed so as to control cooling of the room.

In the event that source 29 provides warm air to heat the space, and further in the event that the room air is cool, both the first and third sensor-actuators will tend to retract their respective pistons. Piston 82 and drive element 87 will pull away from drive arm 84, leaving the damper in the closed position. Piston 107 will move downwardly to drive arm 84 in the clockwise direction, unless second sensor-actuator 102 prevents such movement. Since the supply air 44 is now warm, however, second sensor-actuator 102 will cause piston 103 to extend to permit retraction of piston 107 and engagement of drive arm 84 by drive member or washer 109. This will open the damper assembly and warm air will enter into distribution chamber 43 for discharge out master diffuser outlet 34 and auxiliary outlets 36 and 37.

As room 22a heats up, both pistons 82 and 107 are extended. Extension of piston 82 would cause element 87 to engage and drive arm 84 in a clockwise direction maintaining the damper in the open position, notwithstanding heating up of the room, which is not desirable. Accordingly, the distance between the end 88 of piston 82 and member 106 carried by piston 103 of the second sensor-actuator is selected such that end 88 engages drive member 106 before the drive member 87 can engage drive arm 84 and rotate the damper to the open position. Further sensing of warm air by first sensor-actuator 81, therefore, will cause the first sensor-actuator assembly to be downwardly displaced against override spring 141 which is trapped between a cup 142 on the spacing cartridge and a tab 143 on frame 144. As was the case in connection with frame 126, override spring 141 must exert a force which is less than override spring 128 on the second sensor-actuator unit 102.

Thus, When there is hot supply air, the second sensor-actuator extends piston 103 to position such that drive member 106 overrides piston 82 to prevent first sensor-actuator 81 from controlling in the event of a warm room. At the same time member 106 slides down piston 107 releasing piston 107 for movement of member 109 into driving engagement with drive arm 84. This permits controlling or modulation of heating by third sensor-actuator 111, which contracts to pull the damper toward open when the room is cold and expands to urge the damper assembly toward closed when as the room heats up to the desired heat set point.

Finally, if a heating-only diffuser is desired, the thermal sensor-actuator assembly need only include third sensor-actuator 111. When the room is cold, retraction of piston 107 will pull member 109 and get down against drive arm 84 to open the damper. As the hot supply air is discharged into the room, the secondary air 67 will increase in temperature. This increase, in turn, will be sensed by third sensor-actuator 111 which will extend the piston to urge closing of the damper assembly.

Set Point Adjustment

As will be understood, positioning of the three thermal sensor-actuator units relative to each other will affect the temperature set points for both heating and cooling. Accordingly, it is a further desirable feature of the present invention to provide for adjustment of the relative positions between the sensor-actuator units. This is accomplished by mounting frames 121, 129 and 144 in slots in the two channel defining members 62 and 63. Thus, frame 121 is slidably mounted in a longitudinally extending slot 151, while frame 129 is mounted in longitudinally extending slot 152 and frame 144 is mounted in longitudinally extending slot 153. Each of the frames can, in turn, be mounted to end closure members 154 and 156 by set point adjustment screws 157. Each of the set point adjustment screws 157 may advantageously be formed with a cylindrical section and shoulder at the end closures and a threaded opposite inner end. Threaded inner ends of the set screws are received in mating threaded bores in respective frames 121, 129 and 144. Thus, rotation of the set point screws 157 by a screwdriver like will cause the frames 121, 129 and 144 to be displaced axially along their respective slots so as to change the relative positions and, therefore, the set points of which damper assembly 41 is opened and closed. The slots in FIG. 6 are shown in member 62, but it will be seen from FIG. 7 that the frames extend across to the opposite channel forming member 63, which is formed with similar slots to slottably receive the sensor-actuator unit frames.

Damper Assembly

Damper assembly 41 of the master diffuser of the present invention preferably is formed with a plurality, in this case three, blades 87, 89 and 91. Each of these blades is mounted for pivotal movement and coupled for movement together by damper linkage 161 shown in FIG. 8. The middle blade 87 is driven by displacement drive arm assembly 83, and linkage means 161 mounted on a side 162 (FIG. 4) of housing 31 opposed to the sensor-actuator assembly contains the damper displacement linkage 161. Such a linkage 161 can include lever arm members 163 extending from both sides and fixed to rotate with driven axle 86. The axles 164 and 166 on which blades 89 and 91 are respectively mounted further include linkage arms 167 and 168. Extending between arms 167 and 168 and the central drive arms 163 are two links 169 and 171 which are pivoted at their respective ends to the drive arms on the axles. This system allows rotation of axle 86 to be transmitted through the drive arms to the upper and lower axles so that dampers 89 and 91 are opened and closed simultaneously with damper blade 87. The opposed rotation of the damper blades tends to balance the effect of the pressure forces so as to minimize the forces required to displace the damper by the sensor-actuator units. As best may be seen in FIG. 6, each of the damper blades preferably has a transversely extending felt strip 172 which assists in insuring closure of the damper assembly while minimizing the noise which would otherwise result upon contact and vibration of the damper blades against the inlet duct 42.

What is claimed is:

1. A thermally-powered, master diffuser comprising:

a diffuser housing having an air supply inlet for receipt of supply air, into said housing, an air discharge master outlet for the discharge of air from said housing into a space outside said housing, and an air discharge auxiliary outlet for discharge of air from said housing to a slave diffuser to be coupled to said auxiliary outlet;

a damper assembly movably mounted in said housing at a position between said supply inlet and both of said master outlet and said auxiliary outlet for simultaneous control of the flow of air from said supply inlet into said housing and out of said housing through said master outlet and said auxiliary outlet;

thermal sensor-actuator means mounted proximate said master outlet and said damper assembly and responsive to sensed air temperature to move said damper assembly to simultaneously modulate the air flow discharged from said master outlet and said auxiliary outlet; and air induction means positioned proximate said sensor-actuator means and inducing the flow of air from said space to said sensor-actuator means for control of the position of said damper assembly by sensing the temperature of air from said space.

2. The master diffuser as defined in claim 1 wherein, said master diffuser is formed for use in a system for conditioning air in a structure and said space is a room in said structure;

said air induction means includes an induction channel provided on said housing having an induction inlet to said room, and said induction means includes passageway means communicating said supply air from an upstream side of said damper assembly to said induction channel to induce return air from said room to flow into said induction channel through said inlet; and said thermal sensor-actuator means is responsive to both the temperature of air from said space and the temperature of said supply air.

3. The master diffuser as defined in claim 2 wherein, said thermal sensor-actuator means is mounted in said induction channel; and said induction channel terminates in an outlet for discharge of induced and supply air to said room proximate said master outlet.

4. The master diffuser as defined in claim 1 wherein, said thermal sensor-actuator means includes a plurality of thermal sensor-actuator units, at least one of said sensor-actuator units being mounted to sense the temperature of air from said space, and another of said sensor-actuator units being mounted to sense the temperature of said supply air.

5. The master diffuser as defined in claim 1, and a discharge control plate mounted in said master outlet for movement independently of said damper assembly to enable adjustment of the volume of air discharged from said master outlet.

6. The master diffuser as defined in claim 1, wherein, said damper assembly includes:

at least one movable blade, blade displacement means associated to transmit motion from said thermal sensor-actuator means to said blade, and biasing means biasing said blade to a closed position; and said thermal sensor-actuator means displacing said blade through said blade displacement means toward an open position.

7. The master diffuser as defined in claim 1 wherein,
said damper assembly includes a plurality of movable damper blades, and blade displacement means positioned for displacement by said thermal sensor-actuator means to produce displacement of said blades; and
said thermal sensor-actuator means including a plurality of sensor-actuator units positioned to and displacing said blade displacement means in response to the air temperature sensed thereby.

8. The master diffuser as defined in claim 7 wherein,
said blades are biased toward a closed position;
said thermal sensor-actuator means includes two sensor-actuator units with a first sensor-actuator unit positioned to sense air temperature from said space and a second sensor-actuator unit positioned to sense air temperature of said supply air, said first and second sensor-actuator units and said displacement means cooperatively formed and relatively positioned to produce movement of said blades for both heating and cooling by said master diffuser.

9. The master diffuser as defined in claim 8, wherein,
said first of said sensor-actuator units is mounted in opposed relation to said second of said sensor-actuator units, with each of said sensor-actuator units effecting driving of said displacement means of said damper assembly; and
said first sensor-actuator unit includes overtravel means resiliently mounting said first sensor-actuator unit to a support member, said second sensor-actuator unit displacing said first sensor-actuator unit in a direction opposed to the direction of driving of said displacement means by said first sensor-actuator unit upon sensing of an increasing air temperature, and said second sensor-actuator unit resiliently displacing said overtravel means and said first sensor-actuator unit with respect to said support member.

10. The master diffuser as defined in claim 8 wherein,
said sensor-actuator units are mounted for selective displacement independent thereof relative to said housing for adjustment of the responsiveness of each of said sensor-actuator units to air temperatures sensed.

11. The master diffuser as defined in claim 6 wherein,
said blade is mounted to axle means and said axle means is pivotally supported with respect to said housing; and
said blade displacement means includes drive arm means mounted to one of said axle means and said blade, and said blade displacement means further includes at least one drive arm displacing member carried by said thermal actuator means.

12. The master diffuser as defined in claim 11 wherein,
said thermal actuator means includes three sensor-actuator units with a first sensor-actuator unit being mounted to sense the temperature of air from said space, a second sensor-actuator unit being mounted to sense the temperature of said supply air, and a third of said sensor-actuators being mounted to sense the temperature of air from said space, said first sensor-actuator unit being further positioned to displace said drive arm for rotation of said blade in a first direction upon sensing of an increasing air temperature from said space, said second sensor-actuator unit being positioned to displace said drive arm in said first direction upon sensing of an increasing supply air temperature, and said third sensor-actuator unit displacing said drive arm in said first direction upon sensing of a decreasing air temperature from said space, and biasing means biasing said blade for rotation in a second direction opposed to said first direction.

13. The master diffuser as defined in claim 12 wherein,
said drive arm means includes arms extending outwardly of opposite sides of said axle means, and said sensor-actuator units each carry elements formed to engage said arms to rotate said axle means and said blade.

14. The master diffuser as defined in claim 13 Wherein,
said sensor-actuator units each include override means resiliently mounting said units relative to said housing for displacement in a direction opposed to the direction of displacement of said blade upon sensing of an increasing temperature by each of said first and second sensor-actuator units, and in a direction opposed to the direction of displacement of said blade upon sensing of a decreasing temperature of said air from said space; and
said second sensor-actuator unit is mounted in opposed relation to said first and third sensor-actuator units and carries an element positioned to engage and displace said first sensor-actuator unit against an override means upon the presence of warm supply air and the presence of warm secondary air from said space, and said element carried by said first sensor-actuator further displaces said third sensor-actuator unit against an override means upon the presence of cold supply air.

15. A thermally powered, variable air volume, active master and passive slave diffuser system comprising:
an active master diffuser having a housing with an air supply inlet, a passive air discharge master outlet, and a passive air discharge auxiliary outlet, said master diffuser having a displaceable damper assembly mounted in said housing to control the flow of air from said supply inlet to both of said master outlet and said auxiliary outlet;
at least one passive slave diffuser positioned in spaced relation to said master diffuser and having a passive air discharge slave outlet for discharge air therefrom;
an air supply duct coupled to a source of conditioned air and coupled to said supply inlet;
air distribution duct means coupled between said auxiliary outlet and said slave diffuser for the communication of air to said slave diffuser;
thermal sensor-actuator means positioned in said master diffuser proximate said master outlet and said damper assembly and responsive to temperature changes to displace said damper assembly; and
induction means communicating with said sensor-actuator means and inducing the flow of air from said space over said sensor-actuator means for control of said damper assembly based upon the temperature of air from said space.

16. The thermally powered active master and passive slave diffuser system as defined in claim 15 wherein,
said master diffuser is mounted to discharge air into a first room and said slave diffuser is mounted to discharge air into a second room, and said master outlet and said slave outlet are both provided with means for adjusting the flow of air therefrom independently of said damper assembly.

17. A method of distributing conditioned air into two spaces of a building or the like comprising the steps of:

discharging supply air into a first of said spaces through an active master diffuser assembly having supply inlet, a movable passive master air discharge outlet, at least one auxiliary passive discharge outlet and a movable damper assembly positioned between said inlet and both of the outlets;

sensing the temperature of secondary air in said first of said spaces proximate said master discharge outlet by thermal sensor-actuator means;

displacing said damper by said thermal sensor-actuator in response to said sensing step; and discharging supply air into a second of said spaces through a passive slave diffuser assembly coupled for receipt of supply air from said passive auxiliary outlet of said master diffuser.

* * * * *

UNITED STATES PATENT AND TRADEMARK OFFICE

CERTIFICATE OF CORRECTION

PATENT NO. : 4,821,955

DATED : April 18, 1989

INVENTOR(S) : James R. Kline and Robert S. Hunka

It is certified that error appears in the above-identified patent and that said Letters Patent is hereby corrected as shown below:

Col. 1, line 54, after "thermal" delete "sensor-actuator systems which are capable of cooling" and insert therefor ---sensor-actuators and damper displacement linkages or---.

Col. 2, line 41, delete "entitle" and insert ---entitled---.

Col. 10, line 51, delete "When" and insert ---when---.

Col. 14, line 2 of claim 14, delete "Wherein" and insert ---wherein---.

Signed and Sealed this

Sixteenth Day of January, 1990

*Attest:*

JEFFREY M. SAMUELS

*Attesting Officer*

*Acting Commissioner of Patents and Trademarks*